US005711397A

United States Patent [19]

Flora et al.

[11] Patent Number: 5,711,397

[45] Date of Patent: Jan. 27, 1998

[54] SAFETY DEVICE FOR STEELWORKERS

[76] Inventors: Charles D. Flora, 1303 136th Ave., Sumner, Wash. 98390; Billy D. Davis, 3222 S. Way Rd., Olympia, Wash. 98503

[21] Appl. No.: 383,061

[22] Filed: Feb. 3, 1995

[51] Int. Cl.[6] ..... E06C 7/18

[52] U.S. Cl. ..... 182/3; 248/228.3; 248/229.12; 248/231.41

[58] Field of Search ..... 182/3, 4, 45; 248/228.1, 248/228.2, 228.3, 228.4, 228.5, 228.6, 229.12, 229.22, 229.24, 231.41, 231.61, 316.4

[56] References Cited

U.S. PATENT DOCUMENTS

| | | | |
|---|---|---|---|
| 947,441 | 1/1910 | Hankin et al. . | |
| 1,211,997 | 1/1917 | Ahlander et al. . | |
| 2,303,954 | 12/1942 | Roke . | |
| 3,137,487 | 6/1964 | Lesser . | |
| 3,217,833 | 11/1965 | Smith | 248/228.5 |
| 3,220,691 | 11/1965 | Dudley | 248/228.2 |
| 3,554,477 | 1/1971 | D'Altrui | 248/228.2 |
| 4,037,824 | 7/1977 | Whitmer | 182/3 |
| 4,052,028 | 10/1977 | Cordero, Jr. . | |
| 4,171,032 | 10/1979 | Woolslayer et al. . | |
| 4,606,430 | 8/1986 | Roby et al. . | |
| 4,767,091 | 8/1988 | Cuny . | |
| 4,928,789 | 5/1990 | Claeys . | |
| 4,928,790 | 5/1990 | Franks . | |
| 5,029,670 | 7/1991 | Whitmer . | |
| 5,092,426 | 3/1992 | Rhodes | 182/3 |

*Primary Examiner*—Michael Safavi

[57] ABSTRACT

A safety device for steelworkers. The safety device is adapted to be slidably secured about a flanged beam to attach a lifeline to workmen and to secure the workmen against falls. The safety device includes an elongate, preferably bar member having a plurality of apertures therethrough, and first and second L-shaped jaw members suited for clamping about the flange of the beam. The second L-shaped jaw member is slidably affixed to the elongate member by a slide housing attachment portion which includes a barrel portion which allows the elongate member to slidably pass therethrough in a close fitting relationship. The second L-shaped jaw member also includes at least one aperture through the barrel portion. A locking pin is provided which passes through any one of the plurality of apertures in the elongate member, and, and through the barrel portion of the slide housing attachment portion. The locking pin is repositionable from a first, unengaged position to a second, inserted, locking position, so that when in an inserted position, the locking pin interlocks the elongate member and the slide housing attachment portion, to thereby adjustably fix the distance between the first L-shaped jaw member and the second L-shaped jaw member.

6 Claims, 4 Drawing Sheets

SAFETY DEVICE FOR STEELWORKERS

TECHNICAL FIELD OF THE INVENTION

This invention relates to novel, improved devices for securing a steelworker against falls, and more particularly to a novel safety device for attachment to flanged beam members.

BACKGROUND OF THE INVENTION

Construction of steel frame structures, such as industrial plants and office buildings, often involves the necessity for steelworkers to work at considerable distance above the ground in order to fasten individual beams and other components together. In high rise construction, these activities may take place in an environment subject to wind and weather, as well as subject to the mistakes workers on the project site and to the typical construction site hazards of miscommunication or equipment failure. The Occupational Safety and Health Administration ("OSHA") of the United States, and similar agencies in various states and in other nations, have promulgated regulations which require various safety devices to be used by workers who are occupationally exposed to the potential of a fall from an elevated structure.

In spite of the numerous devices which have so far been offered to the marketplace, a continuing and growing demand exists for a simple, inexpensive device which can be used to preserve live and limb of the steelworker by providing secure fall protection. The need for such devices is especially seen in conjunction with work where significant freedom of movement is needed to enable accomplishment of a particular task, or where improved productivity can result from additional freedom of movement. As will be evident to those familiar with steelwork at great height and to whom this specification is particularly addressed, a device which can both provide additional freedom of movement and assure fail-safe fall protection would be of great benefit in increasing the productivity on a construction project.

Devices of the character just described which provide some of the desired general capabilities have heretofore been proposed. Those of which I am aware are disclosed in U.S. Pat. Nos. 3,217,833 issued Nov. 16, 1965, to Smith for SAFETY DEVICE; 4,037,824 issued Jul. 26, 1977 to Whitmer for SAFETY POST; 4,052,028 issued Oct. 4, 1977 to Cordero, Jr. for STRUCTURAL STEELWORKER'S SAFETY CLAMP; 4,606,430 issued Aug. 19, 1986 to Roby et al. for RAIL MOUNTED SAFETY RESTRAINT DEVICE; 4,767,091 issued Aug. 30, 1988 for ANTIFALL SAFETY DEVICE; and 5,029,670 issued Jul. 9, 1991 to Whitmer for FRAME ERECTION SAFETY SYSTEM AND COMPONENTS THEREOF.

The patent documents identified in the preceding paragraph reveal safety devices of two basic types. First, some devices are fixed at a point of attachment with respect to the steel beam members, such as described in both of the Whitmer patents. The fixed devices of Whitmer provide a method for securing a safety line to a perimeter cable, but inherently limit the steelworker's speed and mobility due to the necessity of stopping to clip on and off of a fixed line. Second, other types of devices are moveable with respect to the beam to which it is attached, as provided in the Smith, Cordero, Jr., Roby et al., and Cuny patents.

In Smith, a rigid, elongated, back support bar is utilized. That device is highly restrictive of movement of the workman. Therefore, Smith's device is not conducive to high productivity. However, Smith's device does provide an adjustable plate and locking pin so that the device can be utilized on beams of various sizes.

In both the Roby et al and Cuny patents, a rolling clamp device is provided for mounting on a steel track or beam, respectively. These devices are relatively large and it would be difficult to require workmen to each carry such a device around a jobsite. Also, both the Roby and Cuny devices utilize an articulating clamp structure which must be properly adjusted and locked in place in order to secure the device. As a result of the articulating structure, both of these devices suffer from the inability to be adjusted for beams of various widths.

Finally, Cordero, Jr. has provided a device which is capable of width adjustment for attachment to beams of various sizes. However, his device has many parts and is relatively clumsy to manipulate between beams during the course of a day's work.

Another common deficiency of the heretofore available safety devices is that they are relatively cumbersome to pick up and relocate to new steel beams. In fact, the combination of complicated operational procedure, relatively heavy weight, and the manipulation and physical orientation requirements of the various prior art devices may well present the risk that an improper operational procedure (or perhaps moments without use of any safety device at all) will expose a workman to taking an unsecured step, thus giving rise to the potential danger of falling. Therefore, the advantage of a device which is very lightweight so as to allow easy movement by hand between steel beams is important and self-evident.

SUMMARY OF THE INVENTION

We have now invented, and disclose herein, novel, improved safety devices which do not have the above-discussed drawbacks common to those heretofore used safety devices of which I am aware. Unlike safety devices heretofore available, my device is simple, compact, relatively inexpensive, lightweight, easy to install and reinstall during use, and otherwise superior to the heretofore proposed ones.

Our novel safety device differs from those devices mentioned above in one respect in that they have a simple slide mechanism. As a consequence the user can place the device in the desired position by a simple manipulation of one slidable flange portion and of and insertion of a safety lock.

Our safety device is for use by workers to provide attachment of fall catchment life-lines to beams at temporary working locations. The devices are of the type that may be releasably and slidably connected to a flanged beam. The safety devices include an elongate bar member having a plurality of first apertures therethrough which are defined by a through wall portion, a first L-shaped jaw member affixed to the elongate bar member, and a second L-shaped jaw member slidably affixed to the elongate bar member by a slide housing attachment portion. The slide housing attachment portion further includes a barrel portion adapted to allow the elongate bar member to slidably pass therethrough in a close fitting relationship, and at least one second aperture through said barrel portion defined by a second through wall portion. A locking pin pin is provided which is adapted to pass through any one of the plurality of first apertures in the elongate bar member, and the second aperture in the barrel portion of the slid housing attachment portion. The locking pin may be repositioned from a first, unengaged position to a second, inserted, locking position, so that when in an inserted position, the locking pin interlocks the elongate bar member and the barrel portion of the slid housing attachment portion, to thereby adjustably fix the distance between the first L-shaped jaw member the said second L-shaped jaw member. In this manner, the distance between the first and the second L-shaped jaw members can be adjusted to fit the safety device to flanged beams of different widths. The locking pin preferably also includes a manually releasable safety catch, which is adapted to positively secure the locking pin when the locking pin is placed in said inserted, locking position. A lifeline attachment portion is provided, preferably including a barrel portion adapted to allow the elongate bar member to slidably pass therethrough in a close fitting relationship, so that the lifeline attachment portion is slideably secured to the elongate bar member. A fixed ring may be included as part of the lifeline attachment portion to enable a worker to connect to the safety device by "snap-in" of a lifeline through use of a carabineer or other quick release fastening device.

Aside from the foregoing, our novel safety device is simple, durable, and relatively inexpensive to manufacture.

OBJECTS, ADVANTAGES, AND FEATURES OF THE INVENTION

From the foregoing, it will be apparent to the reader that one important and primary object of the present invention resides in the provision of novel, improved mechanical devices to provide a means for securing workmen against falls from structures, and at the same time, to enhance their productivity.

Other important but more specific objects of the invention reside in the provision of a safety device as described herein which:

- allows attachment to a beam to be done in a simple, quick, direct manner;
- is relatively simple;
- is extremely light;
- is relatively compact and thereby can be packed in a small space, such as a tool kit or lunchbox;
- in conjunction with the preceding object, has the advantage that is can be carried in any convenient location for easy access and placement when needed during construction operations;
- easily provides by simple visual observation of the user an indication that the device is locked in a secure position;
- are relatively inexpensive;
- are easy to install and remove;
- can be quickly adjusted for slidable engagement with beams of different sizes.

Other important objects, features, and additional advantages of our invention will become apparent to the reader from the foregoing and the appended claims and as the ensuing detailed description and discussion proceeds in conjunction with the accompanying drawing.

DETAILED DESCRIPTION

Figure 1:
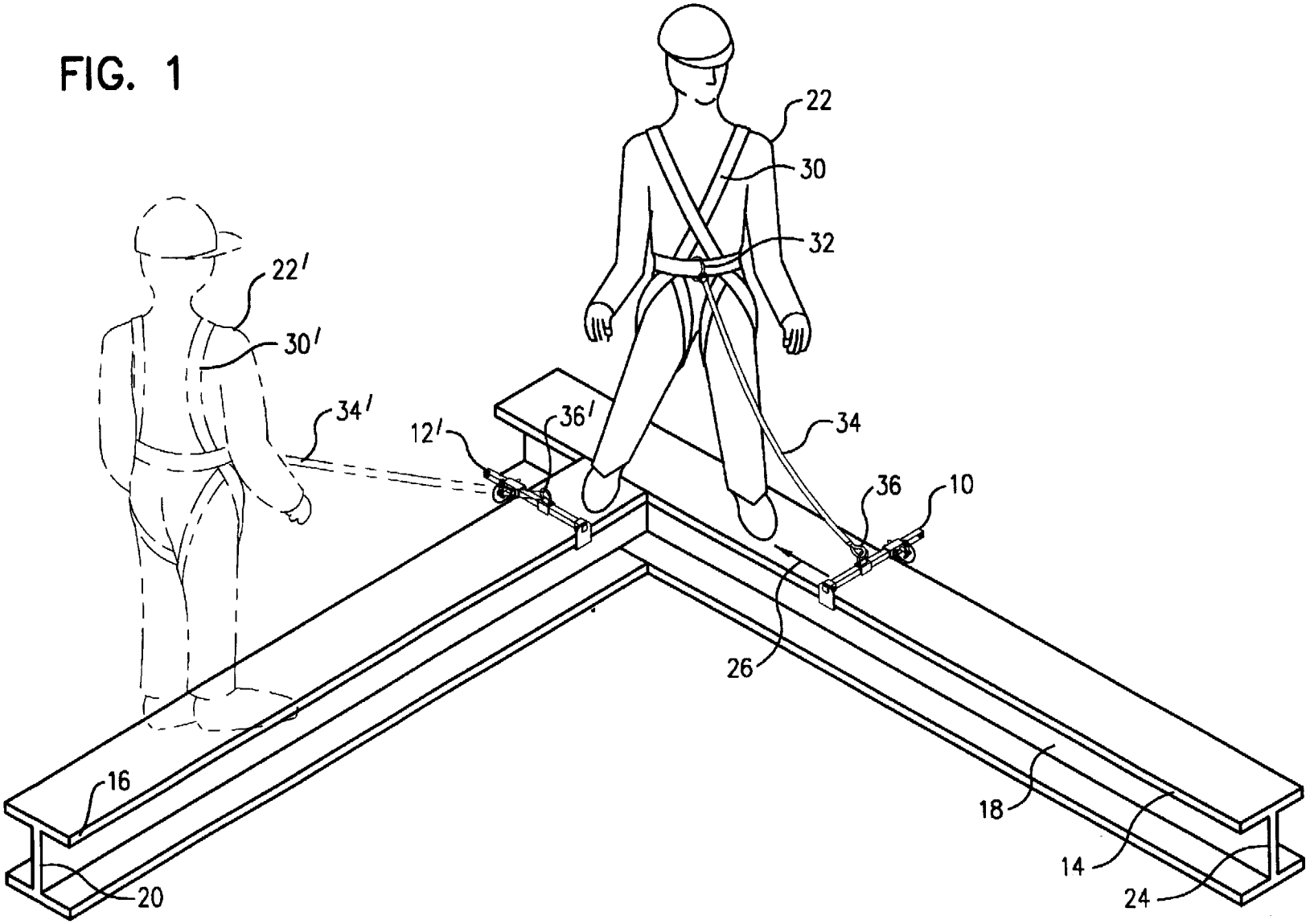
FIG. 1 is a perspective view of a pair of safety devices constructed in accord with the principles of the present invention, shown in their operating position attached to steel I-beams.

Referring now to the drawing, FIG. 1 depicts, in its operative position, safety devices 10 and 12 constructed in accord with, and embodying, the principles of the present invention. The devices are slidably secured to the upper flanged portions 14 and 16 of beams 18 and 20, respectively. As the worker 22 changes locations between beam 18 and beam 20, he/she can "clip-in" to a second safety device 12 before "clipping-out" of a first safety device 10. In that manner, the worker can be secured against falls at all times. As the worker 22 moves toward beam 20 from first end 24 of beam 18, safety device 10 slides along the flange 14 of the beam 18 in the direction of reference arrow 26. Similarly, if the worker 22 moves toward end 24 of beam 18, then the safety device 10 moves in the direction of reference arrow 28, i.e. toward end 24 of the beam 18. At all times, worker 22 wears an appropriate safety harness 30. Harness 30 is secured with an appropriate connector 32 to life-line 34. Quick connection and release of the life-line 34 to the safety devices 10 and 12 can be accomplished by use of clip devices such as carabineer 36, which may be of the locking type, if desired.

Figures 3, 5:
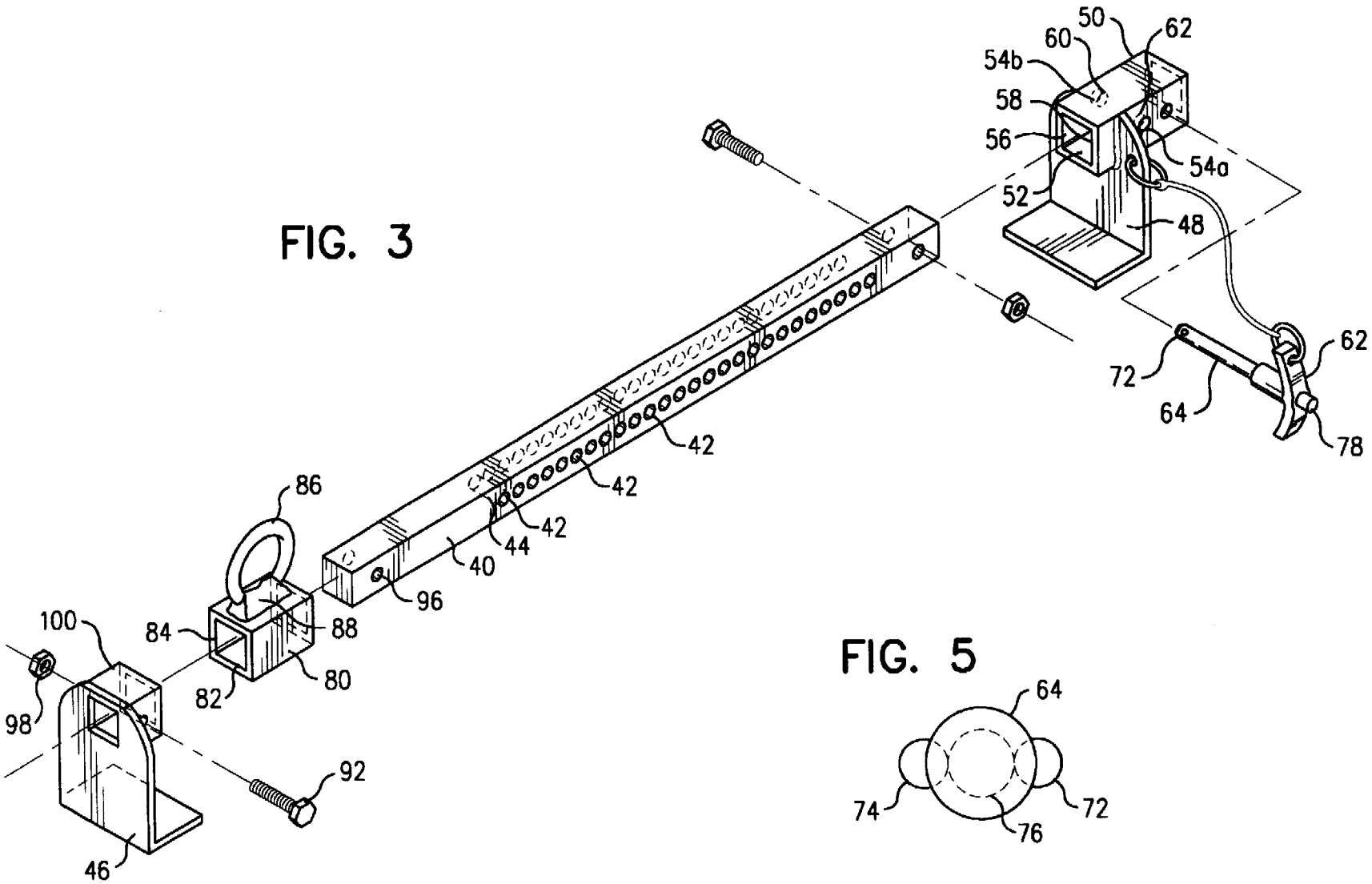
FIG. 3 is an exploded perspective view of an embodiment of our invention, wherein the individual parts are clearly evident.
FIG. 5 is an enlarged end view of the locking pin shaft, showing the safety catch mechanism, and including positioning balls which prevent the locking pin from moving shaftwise to an unlocked position.
Figure 4:
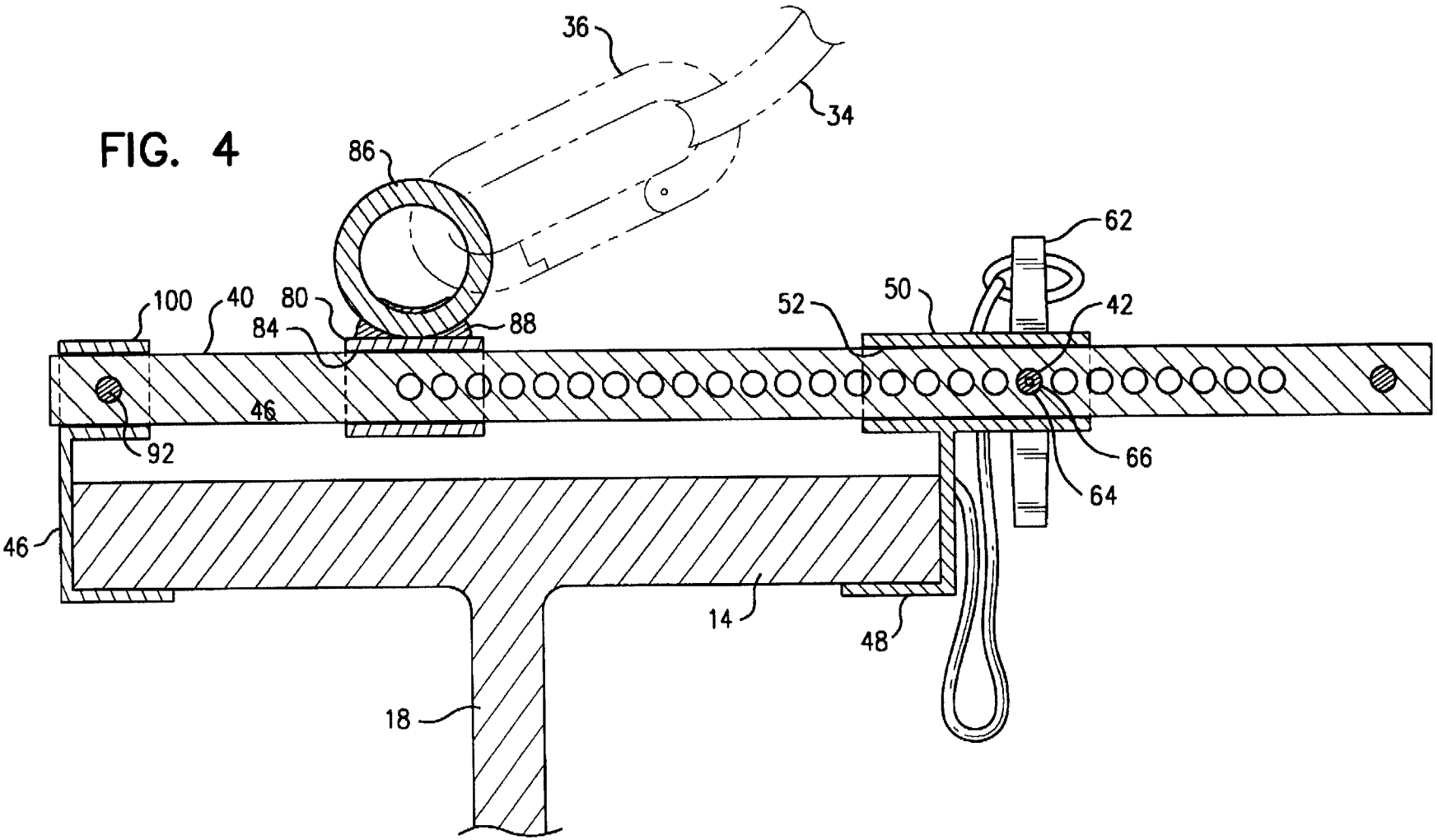
FIG. 4 is a vertical cross sectional view of the device illustrated in FIGS. 1, 2, and 3, taken along the line 4—4 of FIG. 2.

Turning now to FIG. 3, the major components of the safety device 10 can be seen to include: (a) an elongate member 40, preferably of bar stock, having a plurality of first apertures 42 therethrough which are each defined by a through wall portion 44, (b) a first L-shaped jaw member 46 affixed to the elongate bar member 40, and (c) a second L-shaped jaw member 48 which is slidably affixed to the elongate bar member 40 by a slide housing attachment portion 50. The slide housing attachment portion 50 further includes an interior barrel surface portion 52 shaped to allow the elongate bar member 40 to slidably pass therethrough in a close fitting relationship. At least one aperture 54 is provided through the slide housing attachment portion 50, and penetrating the interior barrel surface portion 52. Preferably, the slide housing attachment portion 50 fully encloses the elongate bar member 40, so that a pair of apertures **54*a* and 54*b* are provided at opposing sidewalls 56 and 58. In such cases, the apertures 54*a* and 54*b* are each defined by through wall portions 60 and 62**.

Figure 2:
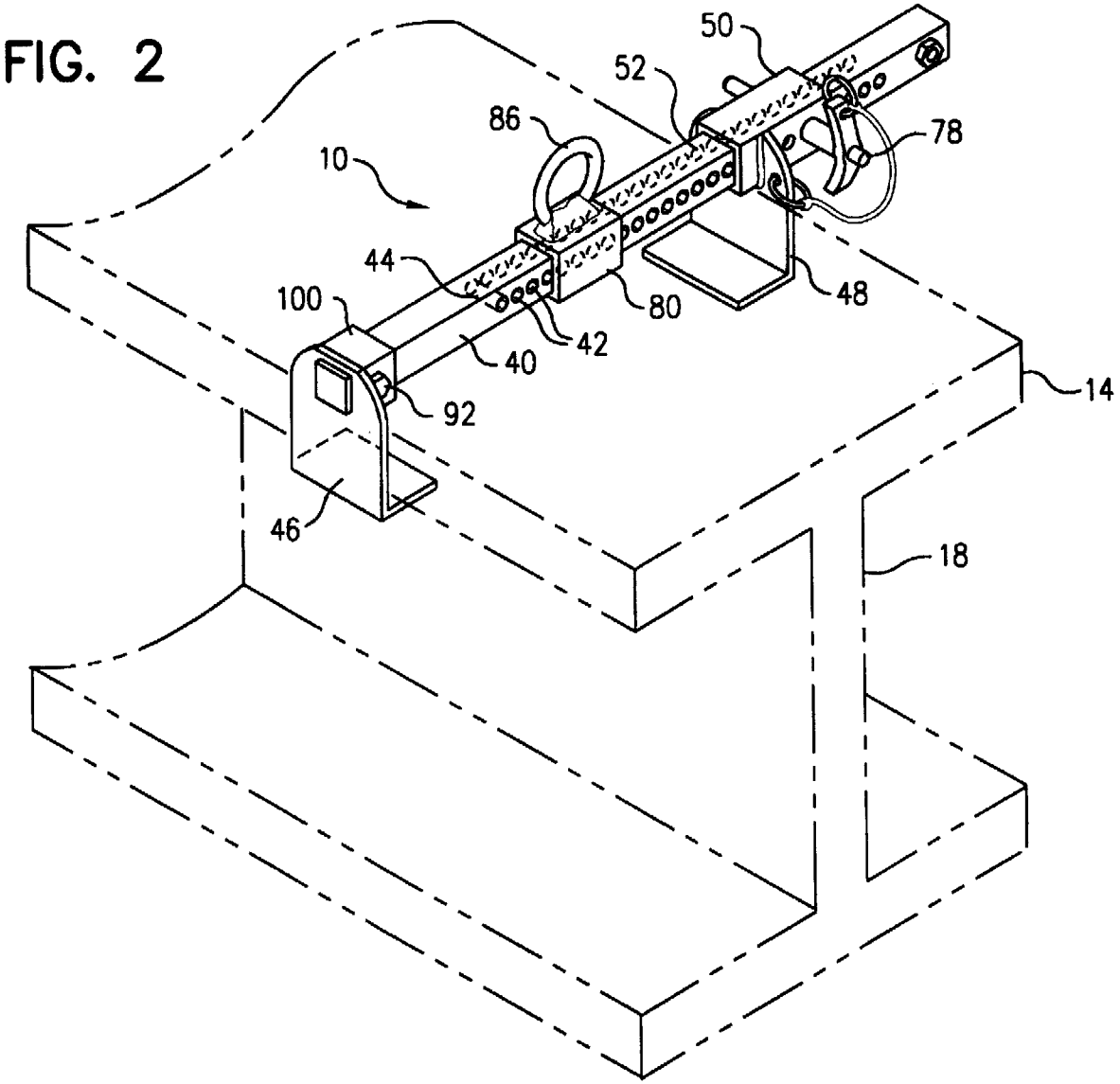
FIG. 2 is a perspective view of a safety device constructed in accordance with the teachings of the present invention, shown during normal operation on an I-beam.

Lock pin 62 is provided to secure the second L-shaped jaw member 48 in a working position. The locking pin 62 is has a shaft member 64 designed to pass through (i) any one of the plurality of first apertures 42 in the elongate bar member 40, and (ii) the apertures **54*a* and 54*b* in the barrel portion 52 of the slide housing attachment portion 50. The locking pin 62 is removed so that the second L-shaped jaw member 48 may be repositioned from a first, unengaged position (locking pin 62 not inserted, as in FIG. 3) to a second, inserted, locking position (locking pin 62 inserted, as in FIG. 2). When locking pin 62 is in an inserted position, the locking pin 62 interlocks the elongate member 40 and the barrel portion 52 of the slide housing attachment portion 50, to thereby adjustably fix the distance between the first L-shaped jaw member 46 and the second L-shaped jaw member 48**.

We prefer to use a locking pin 62 that has a manually releasable safety catch 70. Preferably, the safety catch 70 is configured to positively secure said locking pin 62 when the locking pin 62 is placed in the inserted, locking position. This detail can be further seen in FIG. 5, where there are shown a safety catch including positioning balls 72 and 74 which are preferably biased outward by spring means 76 internal to the locking pin shaft 64. The spring means 76 may be released, so that the positioning balls 72 and 74 are recessed inward to allow shaft 64 to slide through apertures 54*a* and 42, by inward pressure on thumb release 78. When positioning balls 72 and 74 are biased out in the locking position, the locking pin 62 cannot be manually pulled outward through the aperture 54*b* (or apertures 42 and 54*a*) in the slidable housing portion 50 to release the locking pin 62. We prefer to utilize a VIABANK brand "Ball-Lock", model CATA15S, part no. CL-4-BLP-1.50-S. However, any suitable manual operable safety catch may be used with a locking pin 62 so long as the locking pin is positively secured against becoming dislodged.

The safety device also includes a lifeline attachment portion 80 which is preferably slidably secured to the elongate member 40. The lifeline attachment portion 80 further comprises a barrel portion 82 constructed with interior walls 84 shaped to allow the elongate member 40 to slidably pass therethrough in a close fitting relationship. Also, we prefer to use a ring 86, attached by weldment 88 to attachment portion 80, as a secure point for clip-in of the carabineer 36 that attaches the life-line 34.

As seen in FIG. 3, the first L-shaped jaw portion 46 may be secured to the elongate member 40 by way of securing means 90 which can take the form of the working combination of bolt 92 which extends through a central aperture 94 the first L-shaped jaw portion 46 and through an end aperture 96 in elongate member 40, and a fastener such as nut 98 which threadably engages bolt 92. The first L-shaped jaw portion 46 may include a barrel portion 100 to slidably engage the elongate member 40 in the same manner as the other barrel portions described above.

Also, it is to be understood that the exact details of the slidable joint between the elongate member 40 and barrel portions of the important second L-shaped jaw member 48 may be chosen to provide minimum fabrication costs, which may vary depending upon the material of construction. For instance, it may be desirable to utilize a lightweight metal not suitable for use of cast parts. On the other hand, some materials, such as stainless steel, may be best constructed by providing a weld joint certain parts. However, the safety device can be manufactured from any suitable materials of sufficient strength.

It is thus to be appreciated that the novel safety device provided by the present invention, and the way in which it is installed and used by steelworkers, is a significant improvement in the state of the art of safety devices for high rise steel construction activities. Our novel safety device is relatively simple, and it substantially improves the efficiency, productivity and safety of workers that utilize the same. It will be readily apparent to the reader that the our safety device may be easily adapted to other embodiments incorporating the concepts taught herein. Thus, the invention may be embodied in other specific forms without departing from the spirit or essential characteristics thereof. Therefore, the embodiments presented herein are to be considered in all respects as illustrative and not restrictive, the scope of the invention being indicated by the appended claims rather than by the foregoing description, and all changes and devices which are described within the meaning and range of equivalents of the claims set forth herein are therefore intended to be embraced therein.

What is claimed is:

1. A safety device for use by workers to provide attachment for fall catchment life-lines to beams at a temporary working location, said safety device of the type that may be releasably and slideably connected to a flanged beam, said safety device comprising:

(a) an elongate bar member, said elongate bar member having a plurality of apertures therethrough, wherein each of said plurality of apertures is defined by a through wall portion;

(b) a first L-shaped jaw member affixed to said elongate bar member;

(c) a second L-shaped jaw member, said second L-shaped jaw member slidably affixed to said elongate bar member by a slide housing attachment portion, said slide housing attachment portion further comprising (i) a barrel portion adapted to allow said elongate bar member to slidably pass therethrough in a close fitting relationship, and (ii) at least one aperture through said barrel portion, said at least one aperture through said barrel portion defined by a second through wall portion, (d) a lifeline attachment portion, said lifeline attachment portion including a barrel portion, said barrel portion surrounding said elongate bar member in a close fitting relationship and securely and slideably engaged therewith;

(e) a locking pin, said locking pin adapted to pass through (i) any one of said plurality of apertures in said elongate bar member, and (ii) one of said at least one apertures through said barrel portion of said slide housing attachment portion, when repositioned from a first, unengaged position to a second, inserted, locking position, so that when in said second, inserted, locking position, said locking pin penetrates through said barrel portion of said slide housing attachment portion and thereby interlocks said elongate bar member and said barrel portion of said slide housing attachment portion, to thereby adjustably fix the distance between said first L-shaped jaw member and said second L-shaped jaw member.

2. The device of claim 1, wherein said locking pin further comprises a manually releasable safety catch, and wherein said safety catch is adapted to positively secure said locking pin when said locking pin is placed in said second, inserted, locking position.

3. The device as set forth in claim 1, further comprising a ring affixed to said lifeline attachment portion, said ring adapted to receive an attachment means from a lifeline attached to a worker.

4. A safety device for use by workers to provide attachment for fall catchment life-lines to beams at a temporary working location, said safety device of the type that may be releasably and slideably secured about a flanged beam, said safety device comprising:

(a) an elongate bar member, said elongate bar member having a plurality of apertures therethrough, each of said plurality of apertures defined by a through wall portion;

(b) a first L-shaped jaw member affixed to said elongate bar member;

(c) a second L-shaped jaw member, said second L-shaped jaw member slideably affixed to said elongate bar member by a slide housing attachment portion, said slide housing attachment portion further comprising (i) a barrel portion adapted to allow said elongate bar member to slideably pass therethrough in a close fitting relationship, and (ii) at least one aperture through said barrel portion, wherein said at least one aperture through said barrel portion is defined by a second through wall portion;

(d) a lifeline attachment portion, said lifeline attachment portion slideably secured to said elongate bar member, said lifeline attachment portion further comprising a barrel portion adapted to allow said elongate bar member to slideably pass therethrough in a close fitting relationship, so that said lifeline attachment portion is slideably secured to said elongate bar member;

(e) a locking pin, said locking pin adapted to pass through (i) any one of said plurality of apertures in said elongate bar member, and (ii) one of said at least one aperture in said barrel portion of said slide housing attachment portion, when said locking pin is repositioned from a first, unengaged position to a second, inserted, locking position, so that when in an inserted position, said locking pin interlocks said elongate bar member and extends through one of said at least one aperture in said barrel portion of said slide housing attachment portion, to thereby adjustably fix the distance between said first L-shaped jaw member and said second L-shaped jaw member.

5. The device as set forth in claim 4, further comprising a ring affixed to said lifeline attachment portion, said ring adapted to receive an attachment means from a lifeline attached to a worker.

6. The device of claim 4, wherein said locking pin further comprises a manually releasable safety catch, and wherein said safety catch is adapted to positively secure said locking pin when said locking pin is placed in said inserted, locking position.

* * * * *